US005537481A

United States Patent [19]

Voishvillo et al.

[11] Patent Number: 5,537,481

[45] Date of Patent: Jul. 16, 1996

[54] HORN DRIVER

[75] Inventors: Alexander G. Voishvillo; Sergei Shurupov, both of St. Petersburg, Russian Federation

[73] Assignee: The AWS Group, Inc., Wheeling, W. Va.

[21] Appl. No.: 222,858

[22] Filed: Apr. 5, 1994

[51] Int. Cl.[6] ..... H04R 25/00

[52] U.S. Cl. ..... 381/192; 381/156; 381/199; 381/201; 381/202; 381/204; 181/152

[58] Field of Search ..... 381/156, 199, 381/188, 205, 192, 201, 202, 204; 181/152, 159, 177, 199

[56] References Cited

U.S. PATENT DOCUMENTS

| | | | |
|---|---|---|---|
| 2,534,040 | 12/1950 | Lindley | 181/159 |
| 2,907,837 | 10/1959 | Brami | 381/159 |
| 5,357,586 | 10/1994 | Nordschow et al. | 381/159 |

FOREIGN PATENT DOCUMENTS

| | | | |
|---|---|---|---|
| 0142694 | 8/1983 | Japan | 381/156 |

*Primary Examiner*—Curtis Kuntz
*Assistant Examiner*—Sinh Tran
*Attorney, Agent, or Firm*—Webb Ziesenheim Bruening Logsdon Orkin & Hanson

[57] ABSTRACT

A horn driver includes a driver body and pole piece positioned therein. A throat extends through the pole piece along a longitudinal axis through the horn driver. A housing, attached to the driver body, is positioned above an upper portion of the pole piece and spaced therefrom to define a diaphragm chamber. A disk-shaped diaphragm in the diaphragm chamber is above and spaced from the pole piece and below and spaced from the housing. The diaphragm is attached to the housing solely at a central support area. The diaphragm has a ring-like and vibratable diaphragm portion extending radially outward from the central support area to an outer peripheral edge and a voice coil connected to a cylindrical voice coil support along the diaphragm's outer peripheral edge. The diaphragm portion includes an inner diaphragm segment extending upwardly and outwardly from the central support area to a peak point and an outer diaphragm segment extending downwardly and outwardly from the peak point to the outer peripheral edge. The pole piece upper portion has an upper surface shaped similar to and following the diaphragm portion. The spacing between the diaphragm portion and the pole piece increases continuously in a non-linear manner from a minimum near the peripheral edge to a maximum near the central support area. The horn driver includes a device for generating a magnetic field passing through the voice coil and electrical connections to the voice coil.

20 Claims, 6 Drawing Sheets

HORN DRIVER

BACKGROUND OF THE INVENTION

1. Field of the Invention

This invention relates to loudspeaker drivers and, more particularly, to compression drivers for horn speakers.

2. Description of the Prior Art

Drivers which convert an electrical signal into acoustical energy or sound waves and which radiate the sound waves into the air are well known. Such devices are generally broken down into direct radiators, which directly radiate the generated sound waves, and indirect radiators, which require additional elements for radiating the generated sound waves. In a typical arrangement, the conductor for the electrical signal is a coil of thin wire mechanically connected to a flexible diaphragm and positioned in a magnetic field. As an electrical current passes through the coil, mechanical forces are exerted on the coil and cause the diaphragm to move or vibrate and generate the sound waves. In a direct radiator, the diaphragm directly vibrates or moves the surrounding air and generates the sound waves related to the electrical signal. In an indirect radiator, the diaphragm moves against a surface closely spaced thereto and generates high pressure compression waves which are passed through a throat and to a horn or other acoustic generator having a smaller upstream area than the diaphragm. Generally, indirect radiators, such as compression drivers, can generate much higher audible levels when compared with direct radiators and are used, for example, in public address systems.

A typical compression driver for a horn includes a dome-shaped diaphragm positioned above a bore or throat through a pole piece made of a ferromagnetic material. Positioned between the diaphragm and the upstream end of the pole piece throat is a phase plug having an outer surface closely spaced from and conforming identically to the shape of the diaphragm. The phase plug is used to reduce the volume of air to be compressed by the vibrating diaphragm and, thus, reduce the overall impedance of the driver. The phase plug is also used to eliminate certain interfering cancellations in the generated sound waves through carefully designed and positioned passageways or holes through the phase plug. Various passages have been provided in phase plugs, including stacked cone-shaped plugs having annular passages therebetween, arrays of holes and radial slots. For representative patents on compression drivers, see U.S. Pat. Nos. 3,432,002; 4,152,552; 4,336,425; 4,348,549; 4,531,608; 4,718,517; 4,836,327; 4,975,965 and 5,117,462. See also, "Handbook For Sound Engineers", *The New Audio Cyclopedia*, First Edition, 1988, pages 445–455.

While a phase plug is generally essential to the efficient operation of a compression driver, a phase plug is the direct cause of several major problems in compression drivers. Since a long path exists from the outer periphery of the diaphragm to the horn annulus, by way of the phase plug, the generated sound wave is distorted and phase problems and cancellations are created. Moreover, the phase plug adds undesirable second and higher order distortion as well as undesirable non-linear distortion. In addition, since the phase plug must be located extremely close to the diaphragm, excursions of the diaphragm are limited and low frequency generation is compromised. Finally, the upper frequency range of typical compression devices is limited to about 18 kHz. While humans generally cannot hear frequencies at or above this level, the inclusion of the higher frequencies makes the overall sound signal sound more lifelike, particularly in public address systems.

It is, therefore, an object of the present invention to provide a compression operated horn driver which overcomes these drawbacks of the prior art devices. It is an object of the present invention to provide a horn driver which has an extremely wide bandwidth, with increases at both the lower and higher frequencies, which has excellent phase coherence, which has extremely low distortion, and which has a significantly lower nonlinear distortion. It is an object to provide such a horn driver in an arrangement which has less mass, which equalizes the path to the horn annulus, in which the diaphragm assists in dissipating heat, which allows for higher power handling capability and less power compression, and which does not require the diaphragm to be made of an exotic or expensive material.

SUMMARY OF THE INVENTION

Accordingly, we have invented a horn driver which includes a driver body having a central bore extending therethrough along a longitudinal axis. A pole piece is positioned within the central bore and attached to the driver body. The pole piece has a throat extending therethrough from an inlet at an upper portion of the pole piece and to an outlet at a lower portion thereof. The horn driver also includes a housing attached to the driver body. The housing is positioned above the upper portion of the pole piece and is spaced therefrom to define a diaphragm chamber therebetween. The horn driver also includes a disk-shaped diaphragm positioned within the diaphragm chamber above and spaced from the upper portion of the pole piece. The diaphragm has a central support area, a ring-like and vibratable diaphragm portion extending radially outward from the central support area to an outer peripheral edge, a voice coil support connected thereto along its outer peripheral edge and extending therefrom, and a voice coil connected to and extending along the voice coil support. The diaphragm portion includes an inner diaphragm segment extending upwardly and outwardly from the central support area to a peak point and an outer diaphragm segment extending downwardly and outwardly from the peak point to the outer peripheral edge. A center of the diaphragm is aligned with the longitudinal axis. The diaphragm is suspended from and connected to the housing solely at the central support area. The upper portion of the pole piece has an upper surface shaped similar to and following the shape of the diaphragm portion. The spacing between the diaphragm portion and the pole piece increases continuously in a non-linear manner from a minimum spacing near the peripheral edge to a maximum spacing near the central support area. The horn driver also includes a magnetic means for generating a magnetic field which passes through the voice coil and connection means for making electrical connection with the voice coil.

The driver body can include a magnet, a top plate attached to an upper surface of the magnet and a bottom plate attached to a lower surface of the magnet. Each of the top plate, bottom plate and magnet has central bores therethrough which are substantially aligned with each other and extend along the longitudinal axis. The pole piece is positioned within the central bores of the top plate, magnet and bottom plate. The top plate and bottom plate are each formed of a magnetically conductive material and the pole piece is formed at least in part of a magnetically conductive material. The voice coil can be suspended in a gap between the pole piece and the top plate and magnet and the magnetic field generated by the magnet is passed through the top plate, bottom plate and pole piece and through the voice coil. A flux equalizing ring, such as an aluminum ring, can be positioned within the gap immediately beneath the voice coil.

In a preferred embodiment, the inner diaphragm segment has a convex-shaped, curved surface having a first radius of curvature and the outer diaphragm segment has a convex-shaped, curved surface having a second radius of curvature, with the second radius of curvature being larger than the first radius of curvature. In addition, it is preferred that the outer diaphragm segment be wider than the inner diaphragm segment.

The inner and outer diaphragm segments can each have a flat, sloping surface, with the magnitude of the slope of the inner diaphragm segment greater than the magnitude of the slope of the outer diaphragm segment.

It is also preferred that the horn driver further include a cone-shaped baffle attached to a lower surface of the central support area of the diaphragm. The baffle has a base positioned against the central support area and the baffle extends downwardly into the throat area and is spaced from the pole piece. It is preferred that the base of the baffle be no larger than, and preferably conform to, the central support area of the diaphragm.

The upper portion of the pole piece beneath the diaphragm can be formed of a non-magnetically conductive material, with the remainder of the pole piece, including a portion of the pole piece adjacent the voice coil, made of a magnetically conductive material. The diaphragm can be made from a variety of materials, including aluminum, steel, phenolics, titanium, beryllium and composite materials. The horn driver can also include means for mounting a horn thereto and aligned with the outlet of the throat.

The housing can include a cylindrical projection which extends downwardly therefrom and into the diaphragm chamber and contacts an upper surface of the central support area of the diaphragm. The diaphragm can be attached to the housing by a fastener which passes through the cylindrical projection, through the diaphragm central support area and into the baffle, with the central support area sandwiched between and contacting the baffle and the cylindrical projection.

DETAILED DESCRIPTION OF THE PREFERRED EMBODIMENTS

Figure 1:
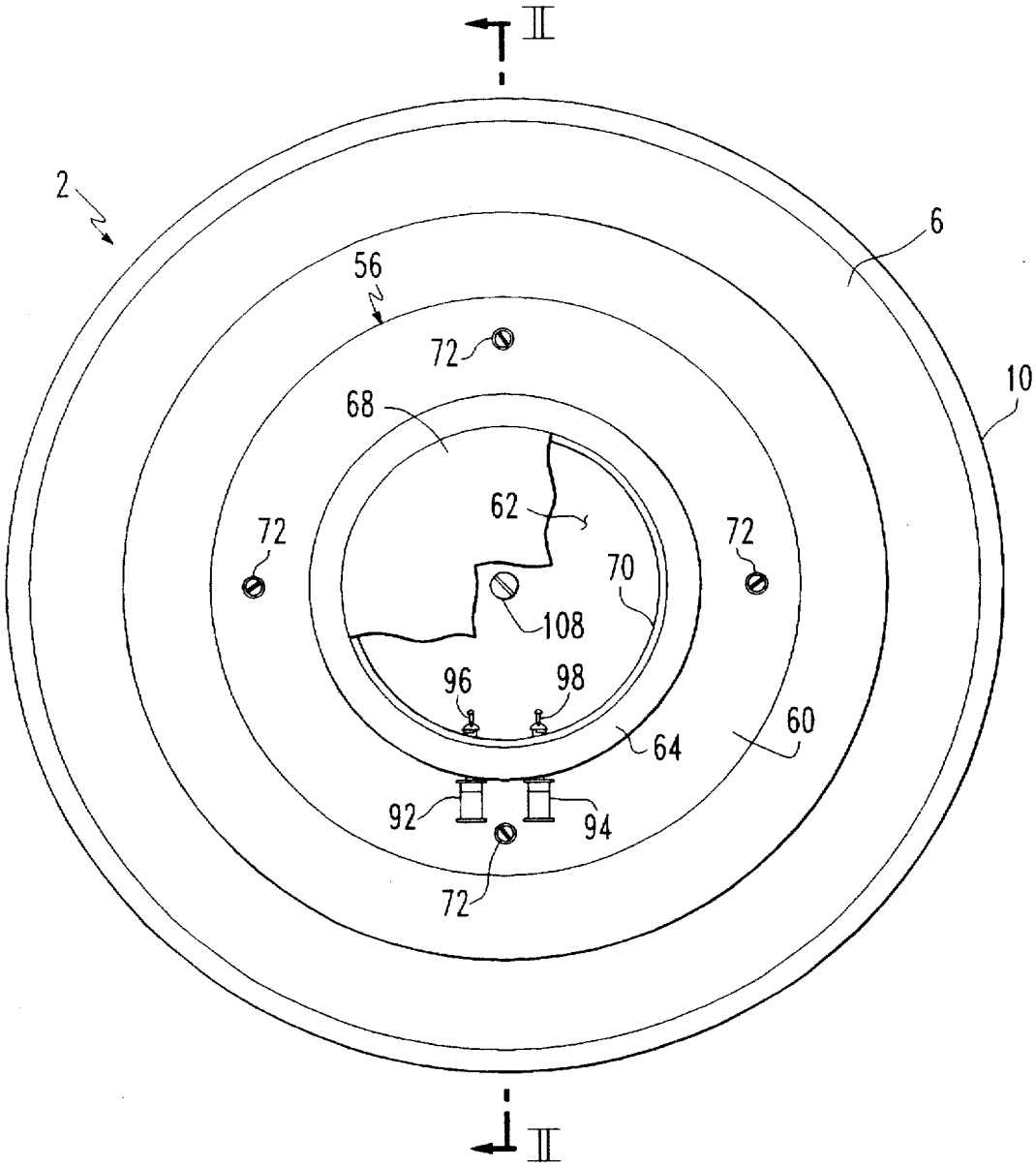
FIG. 1 is a top plan view of one embodiment of a horn driver in accordance with the present invention.
Figure 2:
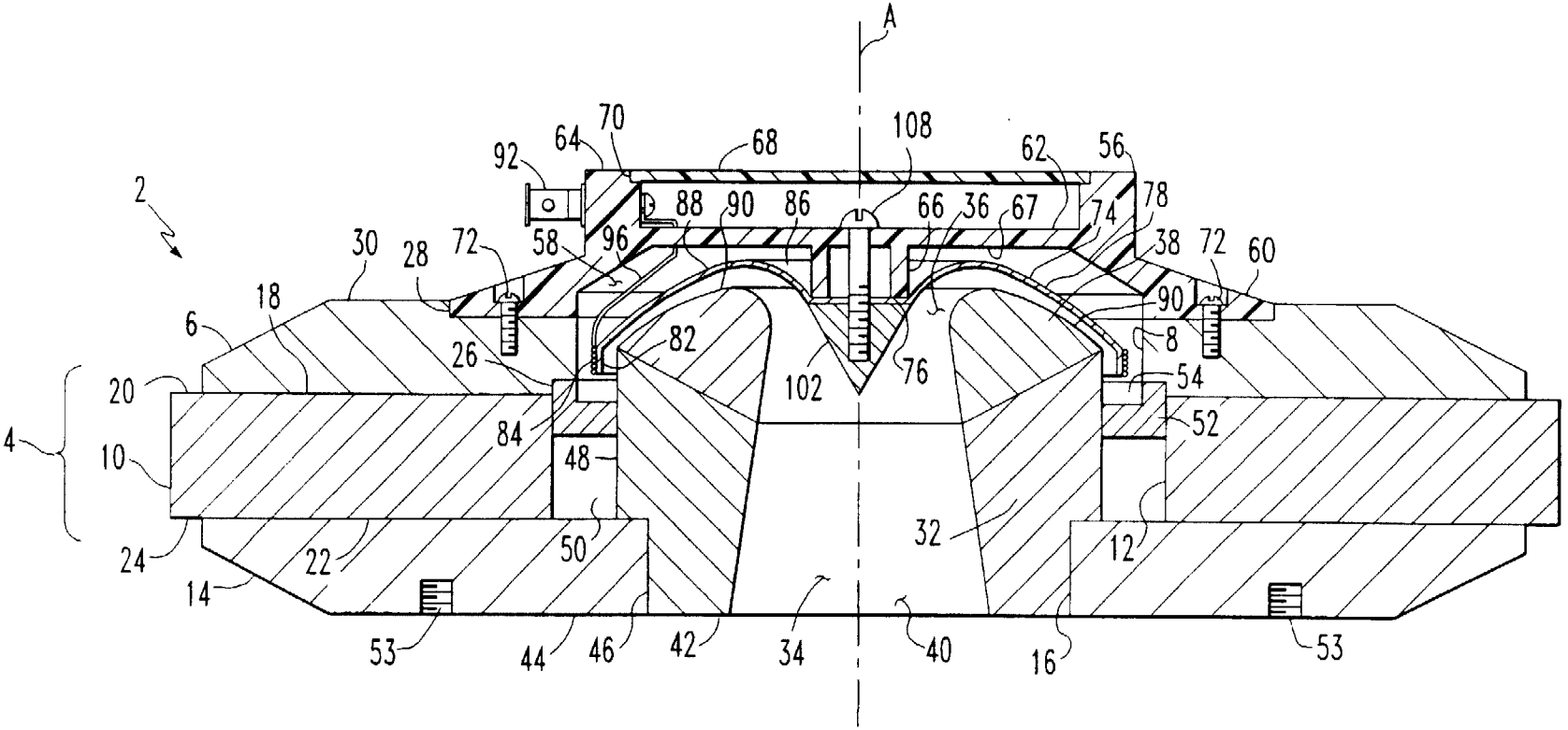
FIG. 2 is a section taken along lines II—II in FIG. 1.
Figure 3:
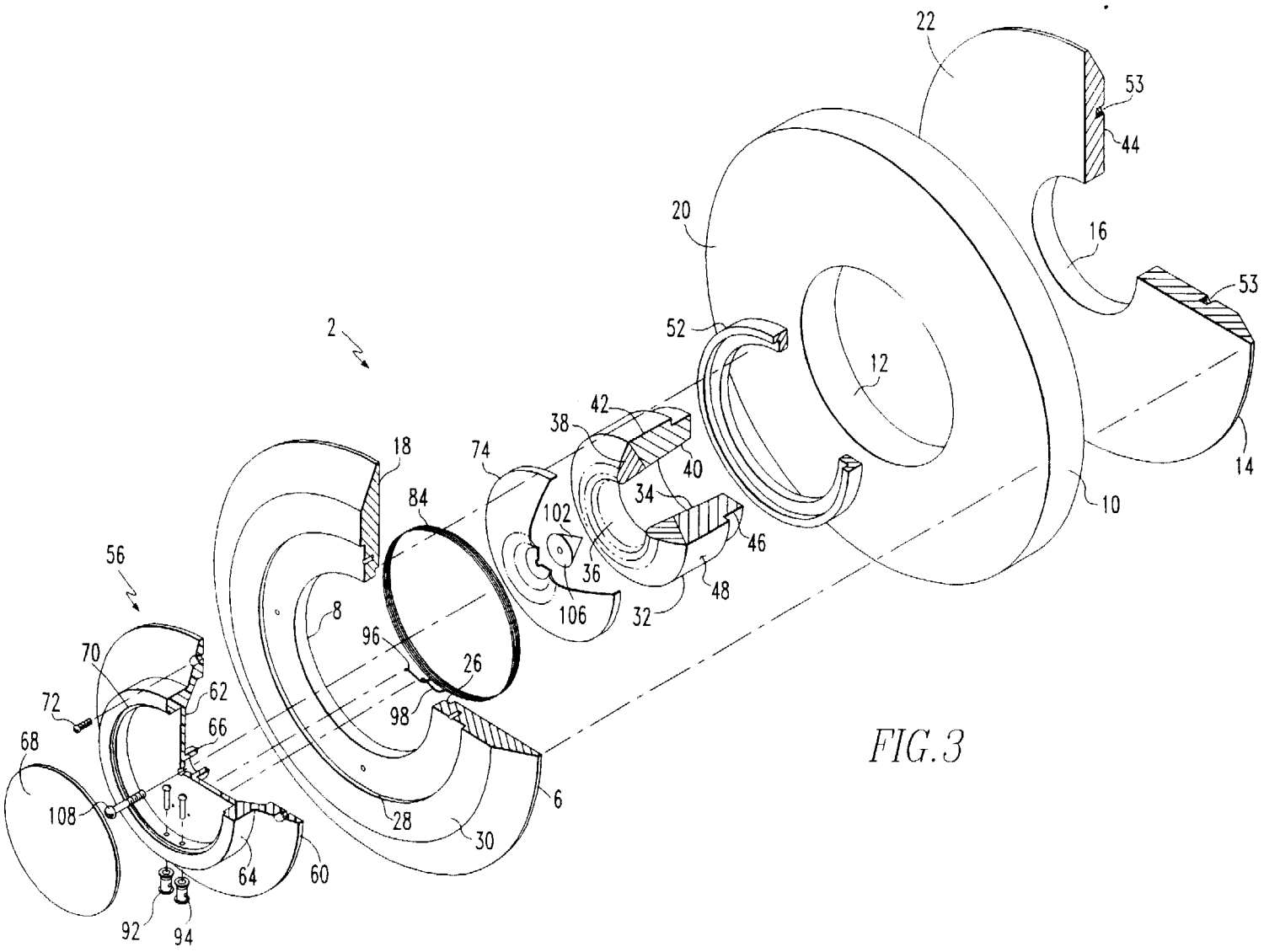
FIG. 3 is an exploded perspective view, partially cut away, of the horn driver shown in FIGS. 1 and 2.

A first embodiment of a horn driver 2 in accordance with the present invention is shown in FIGS. 1–3. The horn driver 2 is basically a flat, cylindrically shaped object including a driver body 4 formed of a plurality of stacked cylindrical body elements. The driver body 4 includes a top plate 6 having a central bore 8 therethrough, a magnet 10 having a central bore 12 therethrough, and a bottom plate 14 having a central bore 16 therethrough. The central bores 8, 12 and 16 of the top plate 6, magnet 10 and bottom plate 14, respectively, are aligned about a longitudinal axis A extending axially through the center of the horn driver 2. The aligned bores 8, 12, 16 form a central bore through the driver body 4. The central bore 16 of the bottom plate 14 is narrower than the central bores 8, 12 through the top plate 6 and magnet 10 and the central bore 8 through the top plate 6 is narrower than the central bore 12 through the magnet 10. The inner surface 18 of the top plate 6 is adhesively affixed to the top surface 20 of the magnet 10, while the inner surface 22 of the bottom plate 14 is adhesively affixed to the bottom surface 24 of the magnet 10. An inner shoulder 26 is provided on the inner surface 18 of the top plate 6 adjacent its central bore 8 and has the same approximate outer diameter as the central bore 12 through the magnet 10. A similar, yet wider, outer shoulder 28 is provided on the outer surface 30 of the top plate 6 adjacent its central bore 8. The functions of the inner shoulder 26 and the outer shoulder 28 of the top plate 6 will be explained hereinafter.

A cylindrical pole piece 32 is positioned in the central bore of the driver body 4 within the aligned central bores 8, 12 and 16 of the top plate 6, magnet 10 and bottom plate 14. The pole piece 32 has a throat 34 extending therethrough along the longitudinal axis A and centered thereon. The throat 34 of the pole piece 32 has an inlet 36 at an upper portion 38 thereof and the throat 34 extends to an outlet 40 at a lower portion 42 thereof. The throat 34 preferably flares outward and gradually becomes wider along its length from the inlet 36 to the outlet 40. The lower portion 42 of the pole piece 32 is preferably flush with an outer surface 44 of the bottom plate 14. A shoulder 46 is provided on the outer surface 48 of the pole piece 32 and extends about its lower portion 42. This shoulder 46 in the pole piece 32 conforms to the central bore 16 of the bottom plate 14 and permits the pole piece 32 to be supported by the bottom plate 14 and adhesively connected thereto. The balance of the pole piece 32 above the shoulder 46 is positioned within central bores 8 and 12 of the top plate 6 and magnet 10, respectively, and the outer surface 48 of the pole piece 32 is spaced therefrom to form a gap 50 therebetween. A flux equalizing ring 52, having an L-shaped cross section, is positioned between and contacts the outer surface 48 of the pole piece 32 and the magnet 10 and top plate 6, in the gap 50 therebetween, with one arm of the flux equalizing ring 52 fitting securely within the inner shoulder 26 of the top plate 6. A coil space 54 is formed in the area of the gap 50 above the flux equalizing ring 52 and between the top plate 6 and pole piece 32. The flux equalizing ring 52 can be secured in place by adhesives or the like. A plurality of threaded holes 53 can be provided through the outer surface 44 of the bottom plate 14 to enable a horn (not shown) to be attached to the horn driver 2 and aligned with the outlet 40 of the throat 34.

The horn driver 2 of the present invention also includes a disk-shaped housing 56 attached to the driver body 4 above the upper portion 38 of the pole piece 32. The housing 56 has its center aligned with the longitudinal axis A of the driver body 4 and is spaced from the pole piece 32 to define a diaphragm chamber 58 therebetween. The housing 56 includes a mounting ring 60 extending about its outer periphery which fits in the outer shoulder 28 in the top plate 6. The housing 56 includes a central plate 62 suspended over the pole piece 32 and connected along its periphery to the mounting ring 60. The housing also includes an integral cylindrical flange 64 extending upwardly from the central plate 62 along its periphery. A cylindrical, preferably hollow, projection 66 extends downwardly from a lower surface 67 of the central plate 62 in its center thereof and aligned with the longitudinal axis A of the driver body 4. The cylindrical projection 66 has an outer diameter which is smaller than the outer diameter of the central plate 62. A housing cover 68 is positioned in and is affixed to a shoulder 70 extending about the upper, inner periphery of the cylindrical flange 64 and encloses the space defined by the cylindrical flange 64 and the central plate 62 of the housing 56. The housing 56 is attached to the top plate 6 of the driver body 4 by a plurality of mounting screws 72 passing through the mounting ring 60.

Figure 4:
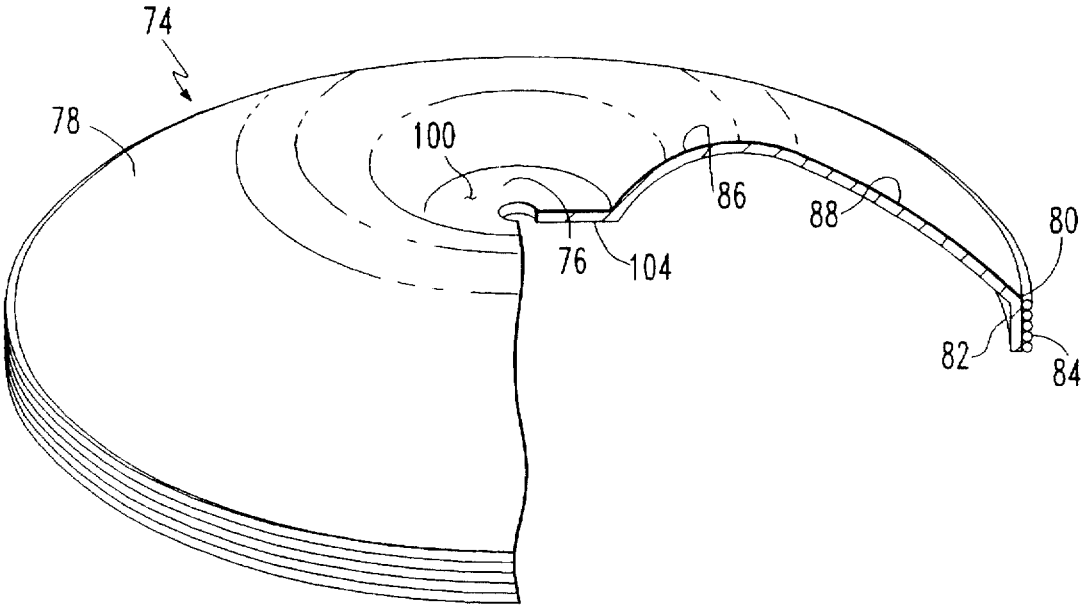
FIG. 4 is a perspective view, partially cut away, of the diaphragm included in the horn driver shown in FIGS. 1–3.

The horn driver 2 also includes a disk-shaped, symmetrical diaphragm 74, shown in FIGS. 2–4. The diaphragm 74 has a central support area 76 which has its center aligned with the longitudinal axis A of the driver body 4. The diaphragm 74 has a ring-like and vibratable diaphragm portion 78 which extends radially outward from the central support area 76 to a circular outer peripheral edge 80. The diaphragm 74 also includes a cylindrical voice coil support 82 connected thereto along its outer peripheral edge 80 and extending downwardly therefrom. A voice coil 84 is connected to and extends along the voice coil support 82, preferably along its outer surface. By making the voice coil support 82 of the same material as and integral with the remainder of the diaphragm 74, heat from the voice coil 84 can be more readily dissipated through the diaphragm 74. As will be explained hereinafter in more detail, the diaphragm portion 78 of the diaphragm 74 includes an inner diaphragm segment 86 extending upwardly and outwardly from the central support area 76 to a peak point and an outer diaphragm segment 88 extending downwardly and outwardly from the peak point to the outer peripheral edge 80. The diaphragm 74 is positioned within the diaphragm chamber 58 above and spaced from the upper portion 38 of the pole piece 32. The diaphragm 74 is suspended from and connected to the housing 56 solely by the central support area 76, otherwise the diaphragm 74 is spaced from the housing 56. The outer peripheral edge 80 of the diaphragm 74 is unsupported and freely moveable within the diaphragm chamber 58. The upper portion 38 of the pole piece 32 has an upper surface 90 shaped similar to and generally following the shape of the diaphragm portion 78. The spacing between the diaphragm portion 78 and the upper surface 90 of the pole piece 32 continuously increases in a non-linear manner from a minimum spacing near the outer peripheral edge 80 of the diaphragm 74 to a maximum spacing near the central support area 76.

The voice coil 84 on the diaphragm 74 is positioned within the coil space 54, but not in contact with the top plate 6, pole piece 32 or flux equalizing ring 52. Electrical connections are made to the voice coil 84 by a pair of connection terminals 92 and 94 mounted to the cylindrical flange 64 of the housing 56 and associated voice coil wires 96 and 98 extending from the terminals 92 and 94, respectively, through the housing 56, into the diaphragm chamber 58 and in contact with the voice coil 84 at its opposite ends thereof.

The diaphragm 74 is positioned within the diaphragm chamber 58 with the upper surface 100 of the central support area 76 contacting the cylindrical projection 66 of the housing 56. A cone-shaped baffle 102 is attached to a lower surface 104 of the central support area 76 of the diaphragm 74. The baffle 102 has a base 106 positioned against the lower surface 104 of the central support area 76. The base 106 of the baffle 102 is no larger than the central support area 76 and preferably conforms to said central support area 76. The baffle is aligned with the longitudinal axis A of the driver body 4 and extends downwardly into the throat 34 and is spaced from the pole piece 32. One arrangement for attaching the baffle 102 to the diaphragm 74 and attaching the diaphragm 74 to the housing 56 is to pass mounting screw 108 through the central plate 62, the cylindrical projection 66, and the central support area 76 of the diaphragm 74, and then into the baffle 102. By tightening mounting screw 108 appropriately, the central support area 76 of the diaphragm 74 is sandwiched tightly between and contacts the baffle 102 and the cylindrical projection 66. By this arrangement, the central support area 76 of the diaphragm 74 is securely fixed to the housing 56 with the remaining diaphragm portion 78 of the diaphragm 74 free to flex within the diaphragm chamber 58 above the pole piece 32.

In accordance with well-known principles, the top plate 6, the bottom plate 14 and at least the lower portion 42 of the pole piece 32 are made of a material which is magnetically conductive. The pole piece 32 forms an opposite pole to the magnet 10 and completes the magnetical flux path within the driver body 4. By this arrangement, a steady or static magnetic flux field passes through the voice coil 84. The voice coil 84 is oriented so that its cylindrical axis is coincident with the longitudinal axis A of the driver body 4 and the throat 34 of the pole piece 32. When a current flows through the voice coil 84, from input signals supplied at the connection terminals 92 and 94, this flow of current through the magnetic field generates mechanical forces on the voice coil 84 which cause the diaphragm portion 78 of the diaphragm 74 to vibrate in a manner related to the input signal current. The flux equalizing ring 52 is made of a non-magnetically conductive material and helps to concentrate the magnetic flux in the area of the voice coil 84. In addition, it is preferred that the upper portion 38 of the pole piece 32 beneath the diaphragm 74 also be formed of a material which does not conduct the magnetic flux. The lower portion 42 of the pole piece 32 should be formed of a magnetically conductive material. The area of the lower portion 42 of the pole piece 32 near its outer surface 48 and immediately adjacent the voice coil 84 and adjacent the coil space 54 should be formed of a magnetically conductive material. In this manner, the magnetic flux is confined to the area of the voice coil 84 and extraneous flux flows in the vicinity of the diaphragm 74, particularly near the inlet 36 to the throat 34, are minimized. Otherwise, these extraneous magnetic flux flows could interfere with the normal operation of the diaphragm 74 in areas away from the voice coil 84.

Figure 5:
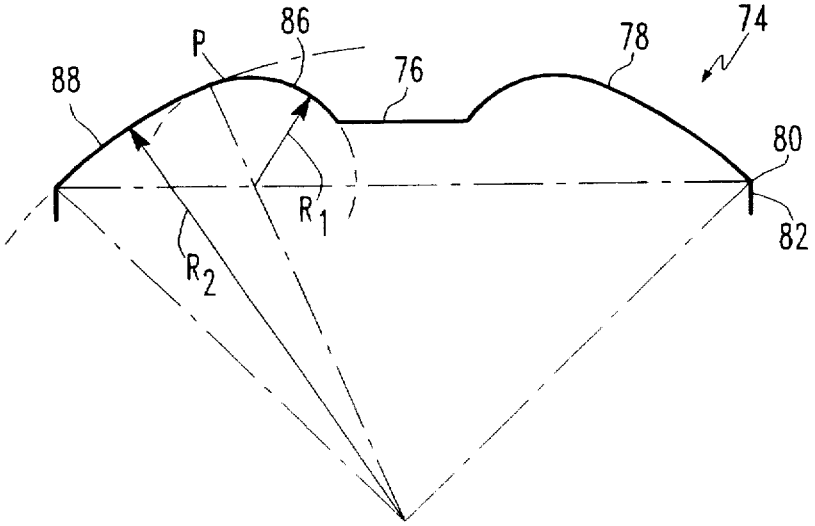
FIG. 5 is a schematic view of a preferred cross-sectional shape of the diaphragm shown in FIGS. 2–4.

While a number of arrangements for the diaphragm 74 can be provided in accordance with the present invention, a shape which is believed to be optimum for purposes of the present invention, which is shown in FIGS. 2 and 3, is shown in more detail in FIG. 4 and is shown schematically in FIG. 5. It is preferred that the inner diaphragm segment 86 and outer diaphragm segment 88 have a convex-shaped, curved surface. In addition, it is preferred that the inner diaphragm segment 86 have a first radius of curvature $R_1$ which is substantially smaller than a second radius of curvature $R_2$ associated with the outer diaphragm segment 88. Moreover, it is preferred that the outer diaphragm segment 88 be wider than the inner diaphragm segment 86. Providing the diaphragm 74 in this configuration serves several functions. A first and main point of suspension for vibration of the diaphragm portion 78 is provided at the central support area 76. By securely fastening this middle portion of the diaphragm 74 to the housing 56, the entire diaphragm portion 78 can vibrate from the outer periphery of the central support area 76 to the outer peripheral edge 80 of the diaphragm portion 78. In addition, the diaphragm portion 78 curves upwardly along the inner diaphragm segment 86 to a peak point, shown as point P in FIG. 5, and then curves downwardly along the outer diaphragm segment 88 to the outer peripheral edge 80. Separate vibrations of the diaphragm portion 78 are provided in this outer diaphragm segment 88 with the peak point P functioning as a second point of suspension for vibrations. The vibrations along the entire diaphragm portion 78 from the central support area 76 to the outer peripheral edge 80 allows much higher frequencies to be generated in an efficient manner. In addition, the vibrations from the second suspension point at peak point P to the outer peripheral edge 80 permits very efficient generation of substantially lower frequencies. By providing only this central physical suspension of the diaphragm 74, much wider physical excursions in the diaphragm portion 78 are permitted when compared with prior art devices which mount the diaphragm along the outer peripheral edge near the voice coil. Basically, the entire diaphragm portion 78 can vibrate about the central support area 76 and this provides a much larger vibrating area with larger excursions and much more linear excursions when compared with prior art devices. Through the arrangement of the present invention, the horn driver 2 can generate a much wider frequency response than prior art designs.

Unlike prior designs, the sound waves generated from vibration of the diaphragm portion 78 against the upper surface 90 of the pole piece 32, which vibration compresses the air therebetween, are transmitted directly to the throat 34 along a path of least resistance in the channel between the lower surface of the diaphragm portion 78 and the upper surface 90 of the pole piece 32. This path of least resistance is formed from the continuously increasing size of the gap or spacing between the pole piece 32 and the diaphragm 74. By positioning the pole piece 32 and diaphragm 74 to have a tight gap in the areas of the higher frequency generation and a loose gap at the areas of the low frequency generation, this eliminates the need for a phase plug and eliminates the distortion in phase incoherencies resulting from a phase plug. The generated sound waves are naturally channeled from the diaphragm 74 to the outlet 40 of the throat 34 without any interference. In addition, the generated sound signals are picked off the diaphragm 74 at different points based on the frequency of the signal. The amount of air compression involved varies based on frequency and losses in the rest of the acoustic system, primarily in a horn attached thereto. The baffle 102 attached to the central support area 76 of the diaphragm 74 functions to fill the upstream areas of the throat 34, channel the sound waves downwardly through the throat 34, and eliminate standing wave interference from overlapping sound signals which are traveling radially inward toward the middle of the throat 34. While a small amount of direct sound radiation may occur from vibration of the diaphragm portion 78 near the central support area 76, the bulk of sound generation is from compression.

The housing 56 is preferably made of a sturdy plastic material. The top plate 6, bottom plate 14 and at least the lower portion 42 of the pole piece 32 are preferably made of a ferrous steel material. The diaphragm 74 can be made from materials such as aluminum, steel, phenolics, titanium, beryllium and composite materials. The flux equalizing ring 52 and baffle 102 are preferably made of aluminum or other non-magnetically conductive materials.

Figure 6:
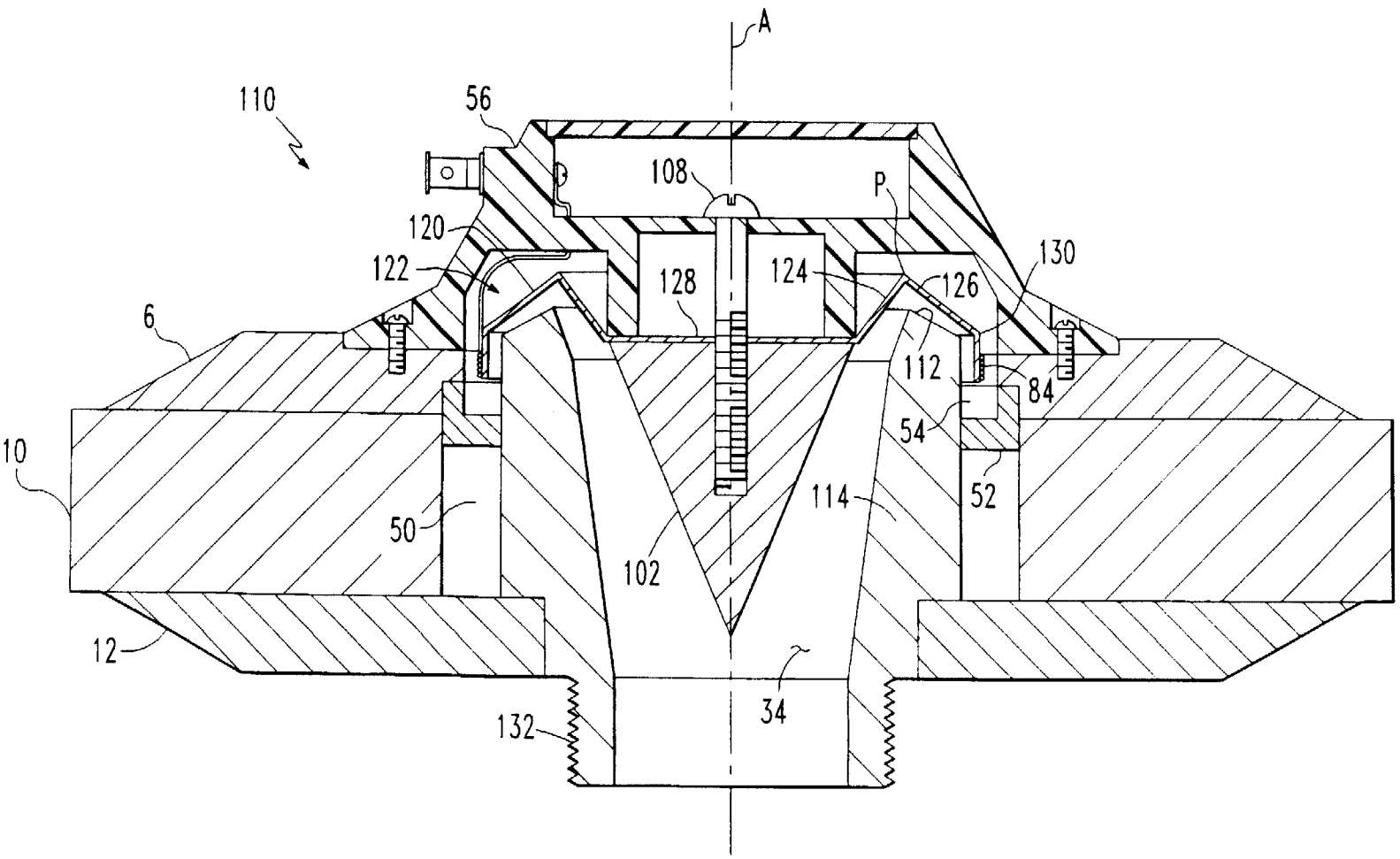
FIG. 6 is a sectional view, similar to FIG. 2, of another embodiment of a horn driver in accordance with the present invention.

A second embodiment of a compression driver in accordance with the present invention is shown in FIG. 6. This embodiment shares many of the same features and elements as the embodiment shown in FIGS. 1–3. Therefore, like reference numbers will be used to identify like elements and only the differences between the two embodiments will be highlighted.

The primary difference between the two embodiments is the shape of the diaphragm and corresponding shape of the upper surface of the pole piece positioned therebeneath. Rather than using curved surfaces as in the FIGS. 1–3 embodiment, the horn driver 110 shown in FIG. 6 uses straight line segments for forming the upper surface 112 of the pole piece 114 and the diaphragm portion 120 of the diaphragm 122 suspended beneath the housing 56. The inner diaphragm segment 124 has a flat, sloping surface and the outer diaphragm segment 126 has a flat, sloping surface. The inner diaphragm segment 124 slopes outwardly and upwardly from the central support area 128 to a peak point P and the outer diaphragm segment 126 slopes downwardly and outwardly from the peak point P to the outer peripheral edge 130 of the diaphragm 122. In this embodiment, the magnitude of the slope of the inner diaphragm segment 124 is greater than the magnitude of the slope of the outer diaphragm segment 126. In addition, this embodiment shows the baffle 102 extending a substantial distance downward into the throat 34 of the pole piece 32. This embodiment also shows the pole piece 114 made entirely of a magnetically conductive material. Moreover, a threaded cylindrical sleeve 132 is provided on the pole piece 114 surrounding the outlet 40 of the throat 34 for attaching a horn (not shown) to the horn driver 110. While the horn driver 110 shown in FIG. 6 functions in a similar manner to the horn driver 2 discussed above in connection with FIGS. 1–3, it may be easier to manufacture the diaphragm 122 shown in FIG. 6. However, horn driver 110 of FIG. 6 will not work nearly as efficiently or with such good results as horn driver 2 shown above in FIGS. 1–3. Therefore, the FIGS. 1–3 embodiment is preferred.

Figure 7:
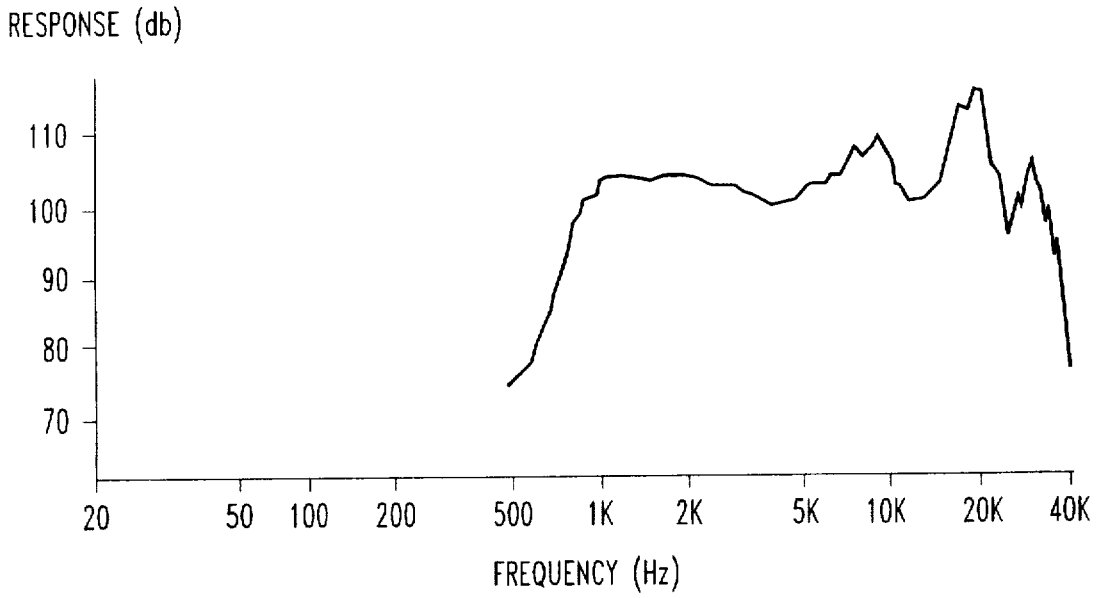
FIG. 7 is a frequency response curve for the horn driver shown in FIGS. 1–3.

FIG. 7 shows a curve of the frequency response of a horn driver which was built in accordance with the FIGS. 1–3 embodiment and tested in a laboratory setting. This curve shows good frequency response from the 1 kHz range up to and including nearly the 30 kHz range. While the human ear cannot generally respond to frequencies above about 15–18 kHz, the inclusion of frequencies above this range makes the generated sound waves "sound" better. Therefore, it is highly desirable to include these higher frequencies in the sound waves generated by a horn driver. Moreover, the second order distortion was very low and the third order distortion was barely measurable.

Having described above the presently preferred embodiments of the present invention, it is to be understood that the invention may be otherwise embodied within the scope of the appended claims.

We claim:

1. A horn driver comprising:

a) a driver body having a central bore extending therethrough along a longitudinal axis;

b) a pole piece positioned within said central bore and attached to said driver body, said pole piece having a throat passing therethrough, with said throat having an inlet at an upper portion of said pole piece and extending to an outlet at a lower portion of said pole piece;

c) a housing attached to said driver body, said housing positioned above the upper portion of said pole piece and spaced therefrom to define a diaphragm chamber therebetween;

d) a disk-shaped diaphragm positioned within said diaphragm chamber above and spaced from the upper portion of said pole piece, said diaphragm having a central support area, a ring-like and vibratable diaphragm portion extending radially outward from said central support area to an outer peripheral edge, a voice coil support connected thereto along said outer peripheral edge and extending therefrom, and a voice coil connected to and extending along said voice coil support, with said diaphragm portion including an inner diaphragm segment extending upwardly and outwardly from said central support area to a peak point and an outer diaphragm segment extending downwardly and outwardly from said peak point to said outer peripheral edge, with each of said inner and outer diaphragm segments having a convex-shaped, curved surface, with a center of said diaphragm aligned with said longitudinal axis, with said diaphragm suspended from and connected to said housing solely at said central support area, with the upper portion of said pole piece having an upper surface shaped similar to and following the shape of said diaphragm portion, and with the spacing between said diaphragm portion and said pole piece increasing continuously in a non-linear manner from a minimum spacing near said peripheral edge to a maximum spacing near said central support area;

e) a cone-shaped baffle attached to a lower surface of the central support area of said diaphragm, with said baffle having a base positioned against said central support area, and with said baffle extending downwardly into said throat and spaced from said pole piece;

f) magnetic means in said driver body for generating a magnetic field which passes through said voice coil connected to said diaphragm; and g) connection means for making electrical connection with said voice coil.

2. A horn driver comprising:

a) a driver body having a central bore extending therethrough along a longitudinal axis;

b) a pole piece positioned within said central bore and attached to said driver body, said pole piece having a throat passing therethrough, with said throat having an inlet at an upper portion of said pole piece and extending to an outlet at a lower portion of said pole piece;

c) a housing attached to said driver body, said housing positioned above the upper portion of said pole piece and spaced therefrom to define a diaphragm chamber therebetween;

d) a disk-shaped diaphragm positioned within said diaphragm chamber above and spaced from the upper portion of said pole piece, said diaphragm having a central support area, a ring-like and vibratable diaphragm portion extending radially outward from said central support area to an outer peripheral edge, a voice coil support connected thereto along said outer peripheral edge and extending therefrom, and a voice coil connected to and extending along said voice coil support, with said diaphragm portion including an inner diaphragm segment extending upwardly and outwardly from said central support area to a peak point and an outer diaphragm segment extending downwardly and outwardly from said peak point to said outer peripheral edge, with said inner diaphragm segment having a convex-shaped, curved surface with a first radius of curvature, with said outer diaphragm segment having a convex-shaped, curved surface with a second radius of curvature, with said second radius of curvature being larger than said first radius of curvature, with a center of said diaphragm aligned with said longitudinal axis, with said diaphragm suspended from and connected to said housing solely at said central support area, with the upper portion of said pole piece having an upper surface shaped similar to and following the shape of said diaphragm portion, and with the spacing between said diaphragm portion and said pole piece increasing continuously in a non-linear manner from a minimum spacing near said peripheral edge to a maximum spacing near said central support area;

e) a cone-shaped baffle attached to a lower surface of the central support area of said diaphragm, with said baffle having a base positioned against and conforming to said central support area, and with said baffle extending downwardly into said throat and spaced from said pole piece;

f) magnetic means in said driver body for generating a magnetic field which passes through said voice coil connected to said diaphragm; and g) connection means for making electrical connection with said voice coil.

3. A horn driver comprising:

a) a driver body having a central bore extending therethrough along a longitudinal axis;

b) a pole piece positioned within said central bore and attached to said driver body, said pole piece having a throat passing therethrough, with said throat having an inlet at an upper portion of said pole piece and extending to an outlet at a lower portion of said pole piece;

c) a housing attached to said driver body, said housing positioned above the upper portion of said pole piece and spaced therefrom to define a diaphragm chamber therebetween;

d) a disk-shaped diaphragm positioned within said diaphragm chamber above and spaced from the upper portion of said pole piece, said diaphragm having a central support area, a ring-like and vibratable diaphragm portion extending radially outward from said central support area to an outer peripheral edge, a voice coil support connected thereto along said outer peripheral edge and extending therefrom, and a voice coil connected to and extending along said voice coil support, with said diaphragm portion including an inner diaphragm segment extending upwardly and outwardly from said central support area to a peak point and an outer diaphragm segment extending downwardly and outwardly from said peak point to said outer peripheral edge, with a center of said diaphragm aligned with said longitudinal axis, with said diaphragm suspended from and connected to said housing solely at said central support area, with the upper portion of said pole piece having an upper surface shaped similar to and following the shape of said diaphragm portion, and with the spacing between said diaphragm portion and said pole piece increasing continuously in a non-linear manner from a minimum spacing near said peripheral edge to a maximum spacing near said central support area;

e) magnetic means in said driver body for generating a magnetic field which passes through said voice coil connected to said diaphragm; and f) connection means for making electrical connection with said voice coil.

4. The horn driver of claim 3 wherein said driver body includes a magnet forming said magnetic means, a top plate attached to an upper surface of said magnet and a bottom plate attached to a lower surface of said magnet, with said top plate, said bottom plate and said magnet having central bores therethrough which are substantially aligned with each other and extend along said longitudinal axis, with said pole piece positioned within the central bores of said top plate, said magnet and said bottom plate.

5. The horn driver of claim 4 wherein said top plate and said bottom plate are each formed of a magnetically conductive material, wherein said pole piece is formed at least in part of a magnetically conductive material, wherein said voice coil is suspended in a gap between said pole piece and said top plate and said magnet, and wherein the magnetic field generated by said magnet is passed through said top plate, said bottom plate and said pole piece and through said voice coil.

6. The horn driver of claim 5 further including a flux equalizing ring positioned within said gap and immediately beneath said voice coil.

7. The horn driver of claim 6 wherein said flux equalizing ring is an aluminum ring.

8. The horn driver of claim 3 wherein each of said inner diaphragm segment and said outer diaphragm segment has a convex-shaped, curved surface.

9. The horn driver of claim 3 wherein said inner diaphragm segment has a convex-shaped, curved surface having a first radius of curvature, wherein said outer diaphragm segment has a convex-shaped, curved surface having a second radius of curvature, with said second radius of curvature being larger than said first radius of curvature.

10. The horn driver of claim 3 wherein said outer diaphragm segment is wider than said inner diaphragm segment.

11. The horn driver of claim 3 wherein said diaphragm is made of a material from the group consisting of aluminum, steel, phenolics, titanium, beryllium and composite materials.

12. The horn driver of claim 3 further including a cone-shaped baffle attached to a lower surface of the central support area of said diaphragm, with said baffle having a base positioned against said central support area, and with said baffle extending downwardly into said throat and spaced from said pole piece.

13. The horn driver of claim 12 wherein the base of said baffle is no larger than the central support area of said diaphragm.

14. The horn driver of claim 12 wherein the base of said baffle conforms to the central support area of said diaphragm.

15. The horn driver of claim 12 wherein said housing includes a cylindrical projection which extends downwardly therefrom into said diaphragm chamber and contacts an upper surface of the central support area of said diaphragm.

16. The horn driver of claim 15 wherein the diaphragm is attached to said housing by a fastening means which passes through said cylindrical projection and through said central support area and into said baffle, with the central support area sandwiched between and contacting said baffle and said cylindrical projection.

17. The horn driver of claim 3 wherein the upper portion of said pole piece beneath said diaphragm is formed of a non-magnetically conductive material and the remainder of said pole piece, including a portion of said pole piece adjacent said voice coil, is made of a magnetically conductive material.

18. The horn driver of claim 3 further including means for mounting thereto a horn aligned with the outlet of said throat.

19. The horn driver of claim 3 wherein said inner diaphragm segment has a flat, sloping surface and wherein said outer diaphragm segment has a flat, sloping surface.

20. The horn driver of claim 19 wherein the magnitude of the slope of said inner diaphragm segment is greater than the magnitude of the slope of said outer diaphragm segment.

* * * * *

UNITED STATES PATENT AND TRADEMARK OFFICE

CERTIFICATE OF CORRECTION

PATENT NO. : 5,537,481

DATED : July 16, 1996

INVENTOR(S) : Alexander G. Voishvillo and Sergei Shurupov

It is certified that error appears in the above-indentified patent and that said Letters Patent is hereby corrected as shown below:

Title page, item '[56] References Cited, U.S. PATENT DOCUMENTS', insert:

--3,432,002 3/1969 Cohen ... 181/31
4,152,552 5/1979 Meyer ... 179/115.5H
4,336,425 6/1982 Renkus ... 179/115.5H
4,348,549 9/1982 Berlant ... 179/1 E
4,531,608 7/1985 Heinz ... 181/172
4,718,517 1/1988 Carlson ... 181/159
4,836,327 6/1989 Andrews et al. ... 181/152
4,975,965 12/1990 Adamson ... 381/156
5,117,462 5/1992 Bie ... 381/156--.

Title page, item '[56] References Cited', after FOREIGN PATENT DOCUMENT information, insert:
--OTHER PUBLICATIONS
"Handbook For Sound Engineers", *The New Audio Cyclopedia*, First Edition, 1988, pages 445-455.--.

Column 2 Line 10 "nonlinear" should read --non-linear--.

Signed and Sealed this

Nineteenth Day of November, 1996

*Attest:*

Bruce Lehman

BRUCE LEHMAN

*Attesting Officer*

*Commissioner of Patents and Trademarks*